US006932887B2

(12) United States Patent
Ono et al.

(10) Patent No.: US 6,932,887 B2
(45) Date of Patent: Aug. 23, 2005

(54) NEWSPAPER FOR OFFSET PRINTING

(75) Inventors: Hiroshi Ono, Tokyo (JP); Fuminari Nonomura, Tokyo (JP); Mizuho Shimoyama, Tokyo (JP); Hideki Fujiwara, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 39 days.

(21) Appl. No.: 10/264,178

(22) Filed: Oct. 3, 2002

(65) Prior Publication Data

US 2003/0073363 A1 Apr. 17, 2003

(30) Foreign Application Priority Data

Oct. 5, 2001 (JP) ..... 2001-309644

(51) Int. Cl.[7] ..... D21H 19/10
(52) U.S. Cl. ..... 162/135; 162/175
(58) Field of Search ..... 162/135, 158, 162/175, 142, 150; 427/395; 106/206.1

(56) References Cited

U.S. PATENT DOCUMENTS 5,916,420 A * 6/1999 Wurster et al. ..... 162/137

6,207,258 B1 * 3/2001 Varnell ..... 428/32.1

* cited by examiner

*Primary Examiner*—Peter Chin
(74) *Attorney, Agent, or Firm*—Knobbe, Martens, Olson & Bear LLP

(57) ABSTRACT

A surface-treatment agent containing at least one type of processed starch selected from a) to c) as listed below is applied to a base paper of a newspaper so that a product of a B-type viscosity of the surface-treatment agent, measured under conditions of 10% concentration at 50° C. (rotor No. 1 at 60 rpm), and an application amount of the surface-treatment agent (both sides) is within a range of 2 to 15 cps·g/m$^2$;

a) Etherified starch, which is etherified by the compound defined in the general formula (1) given below:

$$(AO)_nH \quad (1)$$

wherein A represents an ethylene group or propylene group, while n represents an integer of 1 to 15, b) Carboxylic acid esterified starch, which is esterified by monocarboxylic acid or dicarboxylic acid containing a linear, branched or cyclic alkyl group or alkenyl group having carbon atoms of 4 to 18, and c) Aldehyde starch.

7 Claims, No Drawings

NEWSPAPER FOR OFFSET PRINTING

BACKGROUND OF THE INVENTION

1. Field of the Invention

This invention relates to a newspaper for offset printing, specifically a newspaper for offset printing that offers high surface strength, with improvements in the piling of paper powder on the blanket and the problem of Neppari (over-adhesion), the latter of which is caused by the adherence of paper to the blanket, at the time of offset printing.

2. Description of the Related Art

Recently newspaper printing has experienced a rapid conversion from the conventional relief printing system to the offset printing system, and it is said that more than 80% of today's newspaper production employs offset printing. In the offset printing system a plate, usually referred to as a PS (pre-sensitized) plate, is made, whereupon a dampening solution and ink are supplied to the plate for printing. The plate is a flat plane on which the portion to be printed is processed to serve as a lipophilic surface and the portion not to be printed is processed to serve as a hydrophilic surface. When a dampening solution and ink are supplied to the plate, the ink adheres to the portion to be printed and the dampening solution to the portion not to be printed. The ink is then transferred from the plate to the paper via the blanket.

In offset printing where ink with a relatively high degree of tack is used, printing paper having high surface strength is needed. Also, since a dampening solution is added to the paper surface at the time of printing, if paper having low surface strength or low water resistance is used, paper powder will accumulate on the blanket or become mixed in with the ink, thereby causing the so-called "blur" problem on the print surface. Furthermore, with the weight reduction of the newspaper the demand for improved printing opacity is increasing, and as a means of improving paper opacity white carbon, titanium oxide, talc and other inorganic pigments are increasingly being used as fillers in papermaking. However, these inorganic pigments easily ooze out of the paper layers along with the dampening solution, being one of the paper-powder elements that may pile up on the blanket. Moreover, the increased content of ink-free pulp leads to an increase in ash content in the paper, which may actually worsen the blanket-piling problem.

To address these problems during offset printing, the surface of the paper sheet used for newspaper printing has conventionally been coated with surface-treatment agents containing water-soluble, high-molecular materials such as starch, polyvinyl alcohol or polyacrylamide. These surface-treatment agents increase the strength of the paper surface and help the micro-fiber and fillers on the paper surface to adhere firmly to the sheet of paper. On the other hand, if the application amount increases, the adherence of the paper surface also increases when moistened, causing the so-called "Neppari problem", which is the adherence of the paper to the blanket and may result in the tearing of the paper during printing. Moreover, as a result of using the surface-treatment agents in large amounts, the infiltration of ink into the paper surface is suppressed, which can easily lead to uneven saturation of the ink during color printing (i.e. unevenness in color intensity) due to uneven ink application.

Conventionally, various methods have been proposed to increase the surface strength of paper while reducing its adherence. For example, Japanese Patent Application Laid-open No. 8-13384 discloses a method to reinforce the paper surface strength by coating the surface with a specific polyacrylamide compound and simultaneously increase the water-resistance of the paper surface using polyvalent aldehyde. In Japanese Patent Application Laid-open No. 5-59689, a method to improve the sizing properties, strength and adherence of the paper surface by coating the surface with water composite in which polyvinyl alcohol is mixed with block copolymer of ethylene oxide and propylene oxide has been proposed. In either case, however, neither a reduction in paper-surface adherence nor an increase in surface strength has been sufficiently accomplished, and uneven saturation of the ink arising during color printing has gone unsolved.

Furthermore, the generation of paper powder has conventionally been suppressed through the use of a rosin-emulsion sizing agent and other internal sizing agents to increase the sizing degree of the paper surface and thereby prevent a dampening solution from infiltrating to the inner layers of the paper during offset printing. However, the aforementioned internal sizing agents easily lead to the problem of extensive foaming due to white water in high-speed paper machines such as those used to make newspaper. Moreover, mechanical pulp, in which the sizing effect is difficult to ascertain, is often used as a raw material for newspaper. Therefore, if a retention-aiding agent is used together with the internal sizing agents, the pitch within the papermaking system will be taken into the paper, diminishing the whiteness of the newspaper.

SUMMARY OF THE INVENTION

The purpose of this invention is to provide a newspaper for offset printing that does not cause the piling of paper powder on the blanket and that decreases the occurrence of over-adherence through a low degree of surface adherence.

As a result of a thorough examination with the purpose of creating a newspaper for offset printing that offers excellent workability in the printing process, the inventors have solved the problem by applying a surface-treatment agent containing a specific processed starch to the base paper of a newspaper and then drying the paper. Specifically, the inventors have solved the problem by using at least one type of specific processed starch selected from etherified starch, carboxylic acid esterified starch and aldehyde starch, as a surface-treatment agent, and making the product of the B-type viscosity, measured using rotor No. 1 at 60 rpm under the conditions of 10% concentration at 50° C., and the application amount of the surface-treatment agent to within a range of 2 to 15 cps·g/m$^2$.

DETAILED DESCRIPTION OF THE PREFERRED EMBODIMENT

Conventionally, as mentioned above, the newspaper for offset printing has heretofore been coated with surface-treatment agents whose major components are starch, polyvinyl alcohol or polyacrylamide. However, when the application amount of any of these surface-treatment agents is increased in order to suppress the generation of paper powder, such an increase gives rise to problems during printing, such as uneven ink application in the case of color printing, or the sheet sticking to the blanket due to the adherence of the sheet surface when moistened. In other words, it is possible to reduce the amount of paper powder generated by increasing the application amount of the surface-treatment agents, but by increasing the application amount the adherence of the paper surface worsens and it is thus difficult to improve both these problems simultaneously.

The inventors have found that, by using a specific processed starch as the surface-treatment agent and making the product of the B-type viscosity of the surface-treatment agent, measured using rotor No. 1 at 60 rpm under the conditions of 10% concentration at 50° C., and the application amount of the surface-treatment agent to within a range of 2 to 15 cps·g/m$^2$ (including 3, 4, 5, 6, 7, 8, 9, 10, 11, 12, 13 and 14 cps·g/m$^2$), it is possible to suppress the generation of paper powder while decreasing the adherence of the paper surface. If the value of this product is less than 2 cps·g/m$^2$, the paper-powder reduction effect is not sufficient, whereas if it exceeds 15 cps·g/m$^2$ the reduction effect is sufficient but the adherence of the paper surface increases. It was also found that even if the value of this product was within the range specified in this invention, the suppression of paper-powder generation and an improvement in the adherence of the paper surface could not be achieved at the same time when a native starch or oxidized starch was used. In other words, the suppression of paper-powder generation and an improvement in the adherence of the paper surface of a newspaper for offset printing by the product of the B-type viscosity and the application amount defined in this invention are feasible only when a modified starch having a specific structure and functional group is used as a surface-treatment agent.

The B-type viscosity of the surface-treatment agent used in this invention should preferably be in a range of 5 to 30 cps when measured using rotor No. 1 at 60 rpm under the conditions of 10% concentration at 50° C. If the value is less than 5 cps, the infiltration property of the surface-treatment agent is high, which prevents the surface-treatment agent from staying on the paper surface, so that the paper-powder reduction effect cannot be achieved to a sufficient degree. On the other hand, if the value exceeds 30 cps, the application volume varies greatly and it is thus difficult to obtain products of uniform quality.

Additionally, the application amount of the surface-treatment agent used in this invention should be in a range of 0.05 to 2.0 g/m$^2$ and preferably in a range of 0.1 to 1.0 g/m$^2$ in solid weight per both sides. If the application amount is less than 0.05 g/m$^2$, the paper's surface strength is insufficient and the paper-powder reduction effect may not be achieved to a sufficient degree. On the other hand, if the value exceeds 2.0 g/m$^2$, there are no problems with the strength of the paper surface, but its adherence increases and Neppari problems such as the sheet sticking to the blanket or tearing may occur. The appropriate solid-content concentration of the surface-treatment agent when applied to the base paper should be 3 to 20% by weight.

The specific processed starch used in this invention should preferably be at least one type selected from a) to c) as listed below, and those having high film-forming ability (covering ability) and low rates of water elution.

a) Etherified starch, which is etherified by the compound defined in the general formula (1) given below:

$$(AO)_nH \quad (1)$$

wherein A represents an ethylene group or propylene group, while n represents an integer of 1 to 15, b) Carboxylic acid esterified starch, which is esterified by monocarboxylic acid or dicarboxylic acid containing the linear, branched or cyclic alkyl group or alkenyl group having carbon atoms of 4 to 18, and c) Aldehyde starch.

The preferable etherified starch used in this invention is a hydroxyethyl starch. The reason that this specific type of etherified starch should help suppress the generation of paper powder and reduce the adherence of the paper surface is not quite clear, but it is inferred as follows. The dampening solution added to the paper surface in offset printing can easily penetrate the paper layers, and if the pulp fiber gets too wet the micro-fiber and internal fillers contained in the paper layers will easily be eluted. As a result, it can be inferred that the minute raw materials that ooze out become the basis for paper powder. Moreover, the newspaper have originally high water-absorption ability because of its pulp (paper layer) structure, which facilitates the generation of paper powder. Therefore, the starch with high film-forming ability is inclined to help ink spread in the MD and CD directions of the paper rather than infiltrating in the Z direction, and it is supposed that uneven ink application on the paper surface is minimized, thereby preventing the micro-fiber and internal fillers contained in the paper surface from adhering directly to the blanket. On the other hand, the starch with low film-forming ability has an inferior ability to cover the micro-fiber and fillers, and the dampening solution added to the paper surface in offset printing will easily penetrate the paper layers, which facilitates the elution of the micro-fiber and internal fillers. As a result, it can be inferred that the minute raw materials that ooze out become the basis for paper powder. Particularly, even if the paper surface is moistened with the dampening solution during offset printing, the hydroxyethyl starch firmly adheres to the fiber due to the mutual reaction of the hydrogen bond of the hydroxylethyl group so that the volume of the eluted starch is small, whereby it is supposed that it is possible to reduce the adherence of the paper surface.

The hydroxyethyl starch most suitable for use in this invention is a dried, low-molecular hydroxyethyl starch. As defined in U.S. Pat. No. 5,766,366 and U.S. Pat. No. 5,817,180, for example, the dried low-molecular hydroxyethyl starch is obtained as the low-molecular form of a hydroxyethyl starch in its solid state with a water content of 5 to 17% by acidifying with hydrogen-chloride gas, hydrochloric acid, sulfuric acid or oxidizing with ammonium persulfate, hydrogen peroxide or chloric gas. The dried, low-molecular hydroxyethyl starch, in comparison with the conventionally used hydroxyethyl starch treated in the slurry (wet) condition, has more aldehyde groups forming a hemiacetol bond with cellulose fiber, and because it forms firm bonds with the cellulose fiber through covalent bonding, it can significantly increase the surface strength of paper and is more effective in reducing the generation of paper powder.

The particularly preferable carboxylic acid esterified starch used in this invention is a 1-octenyl/succinic acid esterified starch. It is not quite clear why this specific type of carboxylic acid esterified starch has the effect of suppressing the generation of paper powder and reducing the adherence of the paper surface, but like the etherified starch described above the carboxylic acid esterified starch has high film-forming ability, and it also has high hydrophobic property and thus can lower the free energy on the paper surface, which makes the paper layers more water-resistant and less water absorbent. As a result, it is supposed that the oozing (elution) of the minute raw materials by water is reduced and the generation of paper powder is decreased or eliminated.

It is not quite clear why the aldehyde starch used in this invention has the effect of suppressing the generation of paper powder and reducing the adherence of the paper surface, but it is supposed that it forms a hemiacetol bond with cellulose fiber, which improves the surface strength of paper in its wet condition when the dampening solution is applied in offset printing, thereby suppressing the generation of paper powder. Moreover, the hemiacetol bond with the cellulose fiber reduces the elution rate of the starch by the dampening solution and lowers the adherence of the paper surface, so that it is supposed that the occurrence of Neppari becomes less frequent.

As stated above, the surface-treatment agent having excellent paper-powder reduction effect has ideally high film-forming ability, provides resistance to water absorption and forms a covalent bond with cellulose fiber, and should therefore most preferably be a surface-treatment agent in which a dried, low-molecular hydroxyethyl starch is mixed with a sizing agent.

The preferable content of the specific processed starch used in this invention to the surface-treatment agent in its solid state should be in a range of 20 to 100% by weight. If it is less than 20% by weight, either the adherence of the paper surface or its surface strength may be insufficient.

Additionally, Neppari (adhesive) strength of the newspaper for offset printing provided by this invention should preferably be no greater than 300 mN/3 cm (approximately 30 gf/3 cm). If it is equal to or less than this value, the problems attributable to the adherence of the paper surface will not occur. The Neppari strength specified in this invention is measured as follows: Two patches (4×6 cm) are cut from a newspaper for offset printing. The coated sides of the patches are soaked in 20° C. water for five seconds, and then the two coated sides are stuck together. Next, the base paper of a newspaper is placed on the outer surfaces of the stuck patches and then fed into a roller at a pressure of 50 kg/m$^2$, followed by humidity conditioning at 25° C. and 60%RH for 24 hours. The patches are then shaped into 3×6 cm for use as a sample, and Neppari strength was measured using a tensile tester at a pulling speed of 30 mm/min. The higher the measured value is, the harder it is to exfoliate (in other words, the stronger the adhesion is).

The surface-treatment agent used in this invention may contain—as ingredients other than the starch—sizing agents, water-soluble high polymers, preventives against Neppari, preservatives, antifoaming agents, UV-protection agents, fade-proofing agents, fluorescent brightening agents, viscosity stabilizers, lubricants, anti-lubricants and the like.

As for the sizing agent, preferably it should contain at least two types of sizing agents from styrene-type sizing agents and olefin-type sizing agents. Examples of the styrene-type sizing agent include styrene/acrylate copolymer, styrene/(meth)acrylate copolymer (the term "(meth)acrylate" herein referring to "acrylate and/or methacrylate"), styrene/(meth)acrylate/(meth)acrylate ester copolymer, styrene/maleate copolymer, styrene/maleate half-ester copolymer and styrene/maleate ester copolymer. Examples of the olefin-type sizing agent include ethylene/acrylate copolymer, isobutylene/acrylate copolymer, n-butylene/(meth)acrylate/(meth)acrylate ester copolymer, propylene/maleate copolymer and ethylene/maleate copolymer. Alkylketene dimer, alkenyl succinic anhydride, rosin and the like can also be used as the sizing agent.

The next subject is the water-soluble high polymer. As water-soluble high polymers, oxidized starches other than the specific processed starch provided in this invention, phosphoric acid modified starch, cationized starch, enzyme modified starch and other starches, polyvinyl alcohol, polyacrylamide and the like are given as examples.

No specific device is defined for applying the surface-treatment agent to the base paper of the newspaper. For example, it can be a sizing press, blade-metering sizing press, rod-metering sizing press, gate-role coater, blade coater, bar coater, rod-blade coater, air-knife coater or any other device publicly known and used. Generally, following the application process calendering is performed to smoothen the paper surface, by either machine-calendering with a dual-sided metal roller or soft-calendering through the use of a metal roller and elastic roller.

The base paper of the newspaper used in this invention is made using any publicly known and used paper machine from ground pulp (GP); mechanical pulp (MP) such as thermo-mechanical pulp (TMP), chemothermo-mechanical pulp (CTMP) and semi-chemical pulp; chemical pulp (CP) represented by kraft pulp (KP); ink-free pulp (DIP) obtained after removing the ink from wastepaper containing the aforementioned pulps; and recovered pulp obtained through the dissolution of broke generated in papermaking; which are used independently or mixed at any mining rate. The content of DIP is preferably in a range of 50 to 100%, as judged from the recent trend toward high DIP content. Moreover, the basis weight of the base paper is not particularly defined, but it should range from 34 to 50 g/m$^2$.

If necessary, the base paper of the newspaper used in this invention may contain publicly known and used fillers and chemicals for papermaking. As fillers, white carbon, clay, silica, talc, titanium oxide, calcium carbonate, synthetic resin filler (such as vinyl-chloride resin, polystyrene resin, urea/formalin resin, melamine resin, styrene/butadiene copolymer resin) and the like may be added. In neutral paper, calcium carbonate is particularly effective. As chemicals for papermaking, paper-reinforcing agents such as polyacrylamide high polymer, polyvinyl-alcohol high polymer, cationized starch, urea/formalin resin and melamine/formalin resin; freeness or retention aid such as acrylamide/aminomethyl acrylamide copolymer salt, cationized starch, polyethyleneimine, polyethylene oxide and acrylamide/sodium acrylate copolymer; sizing agents such as rosin sizing agent, rosin-emulsion sizing agent, alkylketene dimer (AKD) and alkenyl succinic anhydride (ASA); or auxiliaries such as aluminum sulfate, UV-protection agent, fade-proofing agent and antifoaming agent may be contained. The physical properties of the base paper of the newspaper must accommodate printing by an offset printing machine. It should be sufficient if the tensile strength, tear strength, elongation and other physical properties of the paper are equivalent to those of regular papers used for newspaper printing.

EXAMPLES

The following is a detailed explanation of this invention using examples. However, the invention is not limited to the examples provided. The part and % in the examples are the part by weight and % by weight, respectively, unless otherwise specified.

Example 1

<Sheet Forming of a Base Paper>

The base paper of a newspaper having a basis weight of 42 g/m$^2$ was produced by mixing 12 parts of softwood kraft pulp, 22 parts of thermo-mechanical pulp and 66 parts of ink-free wastepaper pulp, dissolving the mixture by a refiner to obtain a pulp slurry (paper stock) with freeness adjusted to 110 ml (Canadian-standard freeness), adding white carbon (2% per absolute dry pulp) as a filler, and then forming the mixed materials into a sheet using a twin-wire-type paper machine.

<Application of a Surface-treatment Agent>

The glue liquid of a dried, low-molecular hydroxyethyl starch (trade name, ETHYLE-2015; maker, STALEY Co.;

weight-average molecular weight, 330,000) was diluted to obtain a surface-treatment agent with a solid-content concentration of 6.8%. The surface-treatment agent thus obtained was applied to both sides of the aforementioned base paper of the newspaper (basis weight 42 g/m$^2$) using a gate-role coater at an application rate of 1,300 m/min., and after drying one nip treatment was performed at a linear pressure of 150 kg/cm using a soft calender consisting of a resin roller and metal roller, and a newspaper for offset printing was obtained.

Example 2

A newspaper for offset printing was obtained in a manner similar to that of example 1, except for the use of a dried, low-molecular hydroxyethyl starch (trade name, ETHYLE-2020; maker, STALEY Co.; weight-average molecular weight, 510,000) as a surface-treatment agent and its application at a solid-content concentration of 6.2%.

Example 3

A newspaper for offset printing was obtained in a manner similar to that of example 1, except for the use of a dried, low-molecular hydroxyethyl starch (trade name, ETHYLE-2025; maker, STALEY Co.; weight-average molecular weight, 540,000) as a surface-treatment agent and its application at a solid-content concentration of 5.8%.

Example 4

A newspaper for offset printing was obtained in a manner similar to that of example 1, except for the use of a dried, low-molecular hydroxyethyl starch (trade name, ETHYLE-2035; maker, STALEY Co.; weight-average molecular weight, 840,000) as a surface-treatment agent and its application at a solid-content concentration of 5.2%.

Example 5

A newspaper for offset printing was obtained in a manner similar to that of example 1, except for the use of a glue liquid obtained by mixing 50 parts of a dried, low-molecular hydroxyethyl starch (trade name, ETHYLE-2025; maker, STALEY Co.; weight-average molecular weight, 540,000) and 50 parts of an oxidized starch (trade name, SK-20; maker, Nihon Cornstarch Co., Ltd.; weight-average molecular weight, 570,000) as a surface-treatment agent and its application at a solid-content concentration of 6.0%.

Example 6

A newspaper for offset printing was obtained in a manner similar to that of example 1, except for the use of a glue liquid obtained by mixing 50 parts of a dried, low-molecular hydroxyethyl starch (trade name, ETHYLE-2035; maker, STALEY Co.; weight-average molecular weight, 840,000) and 50 parts of an oxidized starch (trade name, SK-20; maker, Nihon Cornstarch Co., Ltd.; weight-average molecular weight, 570,000) as a surface-treatment agent and its application at a solid-content concentration of 5.5%.

Example 7

A newspaper for offset printing was obtained in a manner similar to that of example 1, except for the use of a glue liquid obtained by mixing 100 parts of a dried, low-molecular hydroxyethyl starch (trade name, ETHYLE-2025; maker, STALEY Co.; weight-average molecular weight, 540,000), 10 parts of a styrene-type sizing agent (trade name, KN-520; maker, Harima Chemicals, Inc.) and 10 parts of an olefin-type sizing agent (trade name, AK-505; maker, Seiko Chemical Industries Co., Ltd.) as a surface-treatment agent and its application at a solid-content concentration of 5.8%.

Example 8

<Sheet Forming of a Base Paper>

The base paper of a newspaper having a basis weight of 42 g/m$^2$ was produced by resolving 100 parts of ink-free wastepaper pulp by a refiner to obtain a pulp slurry (paper stock) with freeness adjusted to 110 ml (Canadian-standard freeness), adding white carbon (1% per absolute dry pulp) and talc (2% per absolute dry pulp) as fillers, and then forming the mixed materials into a sheet using a twin-wire-type paper machine.

<Application of a Surface-treatment Agent>

The glue liquid of a dried, low-molecular hydroxyethyl starch (trade name, ETHYLE-2025; maker, STALEY Co.; weight-average molecular weight, 540,000) was diluted to obtain a surface-treatment agent with a solid-content concentration of 4.5%. The surface-treatment agent thus obtained was applied to both sides of the aforementioned base paper of the newspaper (basis weight 42 g/m$^2$) using a gate-role coater at an application rate of 1,000 m/min., and after drying one nip treatment was performed at a linear pressure of 150 kg/cm using a soft calender consisting of a resin roller and metal roller, and a newspaper for offset printing was obtained.

Example 9

A newspaper for offset printing was obtained in a manner similar to that of example 8, except for the application of the surface-treatment agent at a solid-content concentration of 6.0%.

Example 10

A newspaper for offset printing was obtained in a manner similar to that of example 1, except for the use of a hydroxyethyl starch (trade name, PG-270; maker, PENFORD Corp.; weight-average molecular weight, 1,000,000) as a surface-treatment agent and its application at a solid-content concentration of 6.0%.

Example 11

A newspaper for offset printing was obtained in a manner similar to that of example 1, except for the use of a glue liquid obtained by mixing 50 parts of a hydroxyethyl starch (trade name, PG-270; maker, PENFORD Corp.; weight-average molecular weight, 1,000,000) and 50 parts of an oxidized starch (trade name, SK-20; maker, Nihon Cornstarch Co., Ltd.; weight-average molecular weight, 570,000) as a surface-treatment agent and its application at a solid-content concentration of 6.1%.

Example 12

A newspaper for offset printing was obtained in a manner similar to that of example 1, except for the use of an aldehyde starch (trade name, OC-0087; maker, Oji Cornstarch Co., Ltd.; weight-average molecular weight, 80,000) as a surface-treatment agent and its application at a solid-content concentration of 6.5%.

Example 13

A newspaper for offset printing was obtained in a manner similar to that of example 1, except for the use of a 1-octenyl/succinic acid esterified starch (trade name, Filmkote-370; maker, National Starch and Chemical Company; weight-average molecular weight, 1,120,000) as a surface-treatment agent and its application at a solid-content concentration of 5.5%.

Comparative Example 1

A newspaper for offset printing was obtained in a manner similar to that of example 1, except for the use of a dried, low-molecular hydroxyethyl starch (trade name, ETHYLE-2025; maker, STALEY Co.; weight-average molecular weight, 540,000) as a surface-treatment agent and its application at a solid-content concentration of 3.0%.

Comparative Example 2

A newspaper for offset printing was obtained in a manner similar to that of example 1, except for the use of a dried, low-molecular hydroxyethyl starch (trade name, ETHYLE-2025; maker, STALEY Co.; weight-average molecular weight, 540,000) as a surface-treatment agent and its application at a solid-content concentration of 10.0%.

Comparative Example 3

A newspaper for offset printing was obtained in a manner similar to that of example 1, except for the use of an oxidized starch (trade name, SK-20; maker, Nihon Cornstarch Co., Ltd.; weight-average molecular weight, 570,000) as a surface-treatment agent and its application at a solid-content concentration of 3.0%.

Comparative Example 4

A newspaper for offset printing was obtained in a manner similar to that of example 1, except for the use of an oxidized starch (trade name, SK-20; maker, Nihon Cornstarch Co., Ltd.; weight-average molecular weight, 570,000) as a surface-treatment agent and its application at a solid-content concentration of 10.0%.

Comparative Example 5

A newspaper for offset printing was obtained in a manner similar to that of example 1, except for the use of an oxidized starch (trade name, SK-20; maker, Nihon Cornstarch Co., Ltd.; weight-average molecular weight, 570,000) as a surface-treatment agent and its application at a solid-content concentration of 6.2%.

Comparative Example 6

A newspaper for offset printing was obtained in a manner similar to that of example 8, except for the use of an oxidized starch (trade name, SK-20; maker, Nihon Cornstarch Co., Ltd.; weight-average molecular weight, 570,000) as a surface-treatment agent.

Comparative Example 7

A newspaper for offset printing was obtained in a manner similar to that of example 8, except for the use of an oxidized starch (trade name, SK-20; maker, Nihon Cornstarch Co., Ltd.; weight-average molecular weight, 570,000) as a surface-treatment agent and its application at a solid-content concentration of 4.5%.

The items shown below were measured for the newspaper used for offset printing obtained in the examples and comparative examples. The results are shown in Table 1.

Measurement of B-type viscosity of the surface-treatment agent After adjusting the solid-content concentration of the surface-treatment agent to 10%, the B-type viscosity of the surface-treatment agent was measured at a temperature of 50° C. using rotor No. 1 at 60 rpm.

Evaluation of the amount of paper powder piled-up on the blanket Regarding the newspaper for offset printing provided in examples 1 to 7, and 11 to 13 and comparative examples 1 to 5, the amount of paper powder piled up on the blanket was evaluated as follows: Printing was done using an offset printing machine (Toshiba SYSTEM C-20) with the membrane pressure of the dampening solution set to 0.9 $\mu$m, seal-face density 1.15 and print rate 600 rpm, using a black ink (trade name, News King; maker, Toyo Ink Mfg. Co., Ltd.). After printing 20,000 copies, the paper powder that adhered to the blanket's portion not to be printed (area 200 $cm^2$) was scraped off using ethanol, filtered through a membrane filter with a pore size of 0.45 $\mu$m, and then dried. The powder was weighed and the value was then converted to the amount of paper powder per 100 $cm^2$. For the newspaper for offset printing provided in examples 8 to 10 and comparative examples 6 and 7, the membrane pressure of the dampening solution was set to 1.1 $\mu$m, and the amount of paper powder was measured after printing 60,000 copies. If the amount of paper powder piled is 50 mg or less, there would be no practical problems. The amount of paper powder was measured on both the F and W sides of the newspaper for offset printing.

Measurement of Neppari strength Two patches (4×6 cm) were cut from a newspaper for offset printing. The coated sides of the patches were soaked in 20° C. water for five seconds, and then the two coated sides were stuck together. Next, the base paper of a newspaper was placed on the outer surfaces of the stuck patches and then fed into a roller at a pressure of 50 $kg/m^2$, followed by humidity conditioning at 25° C. and 60%RH for 24 hours. The patches were then shaped into 3×6 cm for use as a sample, and Neppari strength was measured using a tensile tester at a pulling speed of 30 mm/min. The higher the measured value is, the harder it is to exfoliate (in other words, the stronger the adhesion is). It has been specified for this invention that a newspaper for offset printing with Neppari strength of 250 mN/3 cm or less is a paper with "good exfoliation."

TABLE 1

| | B-Type viscosity (cps) | Application amount (both sides) ($g/m^2$) | B-type viscosity × Application amount (cps · $g/m^2$) | Amount of paper powder, F/W (mg/100 $cm^2$) | Neppari strength (mN/3 cm) |
|---|---|---|---|---|---|
| Example 1 | 8.7 | 0.40 | 3.5 | 9/11 | 78 |
| Example 2 | 10.3 | 0.40 | 4.1 | 8/11 | 98 |
| Example 3 | 11.0 | 0.40 | 4.4 | 7/10 | 108 |
| Example 4 | 25.1 | 0.35 | 8.8 | 6/9 | 118 |

TABLE 1-continued

| | B-Type viscosity (cps) | Application amount (both sides) ($g/m^2$) | B-type viscosity × Application amount (cps · $g/m^2$) | Amount of paper powder, F/W (mg/100 $cm^2$) | Neppari strength (mN/3 cm) |
|---|---|---|---|---|---|
| Example 5 | 15.1 | 0.41 | 6.2 | 13/11 | 127 |
| Example 6 | 20.0 | 0.41 | 8.2 | 17/14 | 127 |
| Example 7 | 12.0 | 0.45 | 5.4 | 5/8 | 84 |
| Example 8 | 11.0 | 0.30 | 3.3 | 50/18 | 176 |
| Example 9 | 11.0 | 0.50 | 5.5 | 45/18 | 196 |
| Example 10 | 12.0 | 0.40 | 4.8 | 20/15 | 196 |
| Example 11 | 13.0 | 0.40 | 5.2 | 20/16 | 176 |
| Example 12 | 7.0 | 0.40 | 2.8 | 12/9 | 88 |
| Example 13 | 26.0 | 0.39 | 10.1 | 7/8 | 118 |
| Comparative example 1 | 11.0 | 0.10 | 1.1 | 151/83 | 78 |
| Comparative example 2 | 11.0 | 1.50 | 16.5 | 5/6 | 382 |
| Comparative example 3 | 15.2 | 0.10 | 1.5 | 174/96 | 78 |
| Comparative example 4 | 15.2 | 1.20 | 18.2 | 15/13 | 510 |
| Comparative example 5 | 15.2 | 0.41 | 6.2 | 24/20 | 255 |
| Comparative example 6 | 15.2 | 0.30 | 4.6 | 146/79 | 274 |
| Comparative example 7 | 15.2 | 0.50 | 7.6 | 106/45 | 343 |

As shown in Table 1, in the newspaper for offset printing provided in examples 1 to 13, in which specific modified starches such as hydroxyethyl starch, 1-octenyl/succinic acid esterified starch and aldehyde starch were applied so that the product of the B-type viscosity, measured under the conditions of 10% concentration at 50° C. (rotor No. 1 at 60 rpm), and the application amount was within a range of 2 to 15 cps·$g/m^2$, the amount of paper powder piled up on the blanket during offset printing significantly decreased and the Neppari strength stood at a level that would not cause a problem. Especially in example 7, in which the styrene-type sizing agent and olefin-type sizing agent were used in the surface-treatment agent, there was a decrease in the amount of paper powder generated. Contrastingly, as in comparative examples 1 and 2, when the value of the aforementioned product was out of the range specified in this invention, either the amount of paper powder generated or the Neppari strength increased. Moreover, in newspaper for offset printing provided in comparative examples 3 to 7, in which an oxidized starch was applied, even when the value of the aforementioned product was within the range specified in this invention (comparative examples 5 to 7), either the amount of paper powder piled up on the blanket or the Neppari strength were insufficient.

The present invention includes the following embodiments.

1) A newspaper for offset printing, which is obtained by applying a surface-treatment agent containing a processed starch to a base paper of a newspaper and drying the paper, wherein the processed starch contained in the surface-treatment agent is at least one type selected from a) to c) as listed below, and the product of a B-type viscosity of the surface-treatment agent as measured when using rotor No. 1 at 60 rpm under conditions of 10% concentration at 50° C., and an application amount of the surface-treatment agent on both sides is within the range of 2 to 15 cps·$g/m^2$;

a) Etherified starch, which is etherified by a compound defined in the general formula (1) given below:

$$(AO)_nH \quad (1)$$

wherein A represents an ethylene group or propylene group, while n represents an integer of 1 to 15, b) Carboxylic acid esterified starch, which is esterified by monocarboxylic acid or dicarboxylic acid containing a linear, branched or cyclic alkyl group or alkenyl group having carbon atoms of 4 to 18, and c) Aldehyde starch.

2) The newspaper for offset printing as mentioned in item 1), wherein the content of the processed starch to the surface-treatment agent in its solid state is 20 to 100% by weight.

3) The newspaper for offset printing as mentioned in item 1) or 2), wherein the processed starch contained in the surface-treatment agent is a dried, low-molecular hydroxyethyl starch obtained in low-molecular foam by acidifying or oxidizing a hydroxyethyl starch in its solid state with a water content of 5 to 17%.

4) The newspaper for offset printing as mentioned in any one of items 1) to 3), wherein the surface-treatment agent contains a sizing agent.

5) The newspaper for offset printing as mentioned in item 4), wherein the sizing agent comprises styrene sizing agents and olefin sizing agents.

6) The newspaper for offset printing as mentioned in any one of items 1) to 5), wherein a Neppari strength is no greater than 300 mN/3 cm.

What is claimed is:

1. A newspaper for offset printing comprising:

a base paper; and a surface-treatment agent for offset printing containing a process d starch applied and dried on the base paper, wherein the processed starch constitutes 20–100% by weight of the surface-treatment agent d is at least one type selected from a) to c) as listed below, and the product of (i) a B-type viscosity of the surface-treatment agent as measured when using rotor No. 1 at 60 rpm under conditions of 10% concentration at 50°C., and (ii) an application amount of the surface-treatment agent on both sides of the base paper, which is 0.05–2.0 $g/m^2$, is within the range of 2 to 15 cps·$g/m^2$;

a) Etherified starch, which is etherified by a compound defined in the general formula (1) given below:

$$(AO)_nH \quad (1)$$

wherein A represents an ethylene group or propylene group, while n represents an integer of 1 to 15, b) Carboxylic acid esterified starch, which is esterified by monocarboxylic acid or dicarboxylic acid containing a linear, branched or cyclic alkyl group or alkenyl group having carbon atoms of 4 to 18, and c) Aldehyde starch.

2. The newspaper for offset printing as set forth in claim 1, wherein the processed starch contained in the surface-treatment agent is a dried, low-molecular hydroxyethyl starch obtained in low-molecular foam by acidifying or oxidizing a hydroxyethyl starch in its solid state with a water content of 5 to 17%.

3. The newspaper for offset printing as set forth in claim 1, wherein the surface-treatment agent contains a sizing agent.

4. The newspaper for offset printing as set forth in claim 3, wherein the sizing agent comprises styrene sizing agents and olefin sizing agents.

5. The newspaper for offset printing as set forth in claim 1, wherein a Neppari strength is no greater than 300 mN/3 cm.

6. The newspaper for offset printing as set forth in claim 1, wherein the application amount of the surface-treatment agent on both sides of the base paper is 0.1–1.0 g/m$^2$.

7. The newspaper for offset printing as set forth in claim 1, wherein the B-type viscosity of the surface-treatment agent is 5 to 30 cps.

* * * * *